US006006388A

United States Patent [19]

Young

[11] Patent Number: 6,006,388

[45] Date of Patent: Dec. 28, 1999

[54] DISPENSER FOR DISPENSING CONCENTRATED LIQUID SOAP TO INDUSTRIAL CLEANING APPARATUSES

[76] Inventor: Cecil Blake Young, 3659 Thomasson Crossing Dr., Triangle, Va. 22172

[21] Appl. No.: 09/059,254

[22] Filed: Apr. 14, 1998

[51] Int. Cl.[6] ..... D06F 39/02; A47L 15/44

[52] U.S. Cl. ..... 8/158; 68/17 R; 134/99.2; 222/1; 222/83.5

[58] Field of Search ..... 222/1, 83, 83.5, 222/88; 141/330; 8/158; 68/17 R; 134/99.2

[56] References Cited

U.S. PATENT DOCUMENTS

| | | | |
|---|---|---|---|
| 922,453 | 5/1909 | Burgner . | |
| 2,217,563 | 10/1940 | Sartain | 222/83.5 |
| 2,411,196 | 11/1946 | Dolan | 132/79 |
| 2,435,033 | 1/1948 | Campbell | 215/79 |
| 2,655,290 | 10/1953 | Mansperger | 222/181 |
| 2,714,977 | 8/1955 | Davis | 222/424.5 |
| 2,876,936 | 3/1959 | Lippman | 222/326 |
| 2,979,231 | 4/1961 | Witherspoon, Jr. | 222/83.5 |
| 3,206,073 | 9/1965 | Scislowicz | 222/80 |
| 3,625,213 | 12/1971 | Brown | 128/232 |
| 3,877,499 | 4/1975 | Fluster | 141/310 |
| 3,952,918 | 4/1976 | Poitras et al. | 222/82 |
| 3,981,304 | 9/1976 | Szpur | 128/269 |
| 3,982,666 | 9/1976 | Kleimola et al. | 68/17 R X |
| 4,173,858 | 11/1979 | Cassia | 53/471 |
| 4,234,095 | 11/1980 | Safianoff | 215/232 |
| 4,324,349 | 4/1982 | Kaufman | 222/207 |
| 4,391,309 | 7/1983 | Steiner | 141/18 |
| 4,421,249 | 12/1983 | Williamson et al. | 222/88 |
| 4,492,320 | 1/1985 | Tada | 222/398 |
| 4,565,750 | 1/1986 | Isoi et al. | 429/72 |
| 4,645,097 | 2/1987 | Kaufman | 222/207 |
| 4,667,854 | 5/1987 | McDermott et al. . | |
| 4,673,404 | 6/1987 | Gustavsson | 604/411 |
| 4,679,709 | 7/1987 | Poitras et al. | 222/180 |
| 4,691,721 | 9/1987 | Nystuen . | |
| 4,699,188 | 10/1987 | Baker et al. | 141/330 X |
| 4,763,676 | 8/1988 | Mizuno . | |
| 4,765,511 | 8/1988 | Clements | 222/83 |
| 4,871,096 | 10/1989 | Horian | 222/487 |
| 4,998,850 | 3/1991 | Crowell | 222/88 X |
| 5,025,945 | 6/1991 | Lyon | 220/85 H |

(List continued on next page.)

FOREIGN PATENT DOCUMENTS

| | | | |
|---|---|---|---|
| 270592 | 10/1993 | Japan | 222/83 |

OTHER PUBLICATIONS

ECOLAB® product, Model No. SIMPLEX, Serial No. Oct. 31, 1995 1529, Ecolab Center, St. Paul, MN 55102, manufacturing location SB (Photographs 1 and 2).

"Hydro, Proportioning and Dispensing Systems", Hydro Systems Company, Product Catalog, Jul. 1, 1992.

"The 'One Shot'", Product Advertisement, Knight Equipment Corp., no date.

Knight Update, "Introducing . . . The "One Shot" Liquid Dispenser", Product Advertisement, Jun. 15, 1993.

"The Mixing Station," Product Advertisement, Knight Equipment International, Inc., no date.

"Probe Four Liquid Laundry System", Product Advertisement, no date.

"Automatic feeding and proportioning devices for a wide variety of applications," Catalog 90, Dema, no date.

"Chemical Proportioning Systems", Product Advertisement, Knight Equipment International, Inc., no date.

"Green Earth II Chemical Management System," Product Advertisement, BETCO, no date.

*Primary Examiner*—Philip R. Coe
*Attorney, Agent, or Firm*—Kenyon & Kenyon

[57] ABSTRACT

A liquid soap dispenser for dispensing concentrated liquid soap to industrial cleaning apparatuses is disclosed. The dispenser includes a receiver and a seal opener. The receiver is comprised of an upper support structure and a lower soap reservoir. The upper support structure defines an interior chamber for receiving and supporting a liquid soap container. The lower soap reservoir defines an opening through which liquid soap is ultimately dispensed. The seal opener is disposed within the receiver at a lower end of the upper support structure.

65 Claims, 5 Drawing Sheets

U.S. PATENT DOCUMENTS

| | | | |
|---|---|---|---|
| 5,033,649 | 7/1991 | Copeland et al. . | |
| 5,071,035 | 12/1991 | Kiplinger | 222/83.5 |
| 5,071,039 | 12/1991 | Anglehart | 222/158 |
| 5,072,762 | 12/1991 | Jimenez | 141/329 |
| 5,121,778 | 6/1992 | Baker et al. | 141/330 X |
| 5,125,541 | 6/1992 | Anglehart | 222/158 |
| 5,174,476 | 12/1992 | Steiner et al. | 222/181 |
| 5,248,066 | 9/1993 | Olson et al. . | |
| 5,280,764 | 1/1994 | Levinrad | 141/330 |
| 5,325,995 | 7/1994 | Harrison et al. | 222/81 |
| 5,326,237 | 7/1994 | Cecil et al. | 417/511 |
| 5,334,180 | 8/1994 | Adolf et al. | 604/411 |
| 5,335,821 | 8/1994 | Osgar | 222/83 |
| 5,351,860 | 10/1994 | Gotoh | 222/83 |
| 5,352,191 | 10/1994 | Sunago et al. | 604/7 |
| 5,370,164 | 12/1994 | Galloway | 141/329 |
| 5,383,499 | 1/1995 | Mattern | 141/51 |
| 5,392,828 | 2/1995 | Watson et al. | 141/330 |
| 5,400,923 | 3/1995 | Golias et al. | 222/82 |
| 5,413,246 | 5/1995 | Godolphin et al. | 222/1 |
| 5,435,460 | 7/1995 | Osgar | 222/1 |
| 5,445,288 | 8/1995 | Banks | 222/95 |
| 5,472,112 | 12/1995 | Maciejewski | 220/745 |
| 5,494,644 | 2/1996 | Thomas et al. . | |
| 5,595,223 | 1/1997 | Hayao | 141/330 X |
| 5,655,563 | 8/1997 | Johnson . | |
| 5,782,109 | 7/1998 | Spriggs et al. . | |
| 5,853,034 | 12/1998 | Edwards et al. . | |

DISPENSER FOR DISPENSING CONCENTRATED LIQUID SOAP TO INDUSTRIAL CLEANING APPARATUSES

BACKGROUND OF THE INVENTION

The present invention relates to liquid soap dispensers. More specifically, the invention provides for dispensing concentrated liquid soaps for use in industrial cleaning apparatuses.

Liquid soaps used in industrial cleaning apparatuses, e.g., laundry machines, dishwashers, pot sinks, housekeeping applications, etc., are stored in containers in a concentrated form and are generally caustic in nature. Due to the concentrated form and caustic nature of these industrial cleaning soaps, it is undesirable for a person who is dispensing the concentrated soap into an industrial cleaning apparatus to come into contact with it in its concentrated form. Currently, these types of industrial cleaning soaps are stored in gallon containers, e.g., in either 5, 15 or 55 gallon drums.

Due to the caustic nature of the concentrated soaps and their storage in relatively large containers, soap dispensers are used to dispense the soaps for delivery to industrial cleaning apparatuses. Currently known methods for dispensing industrial soaps from their containers present drawbacks, including the use of complex pumping and/or mixing apparatuses that call be costly to procure and repair and difficult to operate.

An example of a currently known dispensing system employs a soap container that is placed in an upright position with a pump mechanism arranged to draw a suction on the container. With this system, soap is pumped from the container to the cleaning apparatus. A problem with these types of dispensing systems is that should the pumping mechanism become inoperative, the soap cannot be drawn from its container. Due to the caustic nature and concentrated form of the soap it is generally not recommended that a user manually pour the soap from the container to the cleaning apparatus in order to avoid spillage or over use.

Additional problems associated with the soap container being placed in an upright position is the effect on efficiency. Because the soap collects in the bottom of the container, it may be difficult to pump all of the soap from the container, leaving a significant portion of the soap unused.

Soap dispensers are also known for dispensing soap to industrial cleaning apparatuses where dry, particulate soap powders and solid detergents are stored in a container and a water spray is directed onto the powder or solid to liquefy the soap and provide the liquid soap to the cleaning device. However, these types of dispensers require an additional step of first liquefying the soap before it can be dispensed. Spray mechanisms, and controls for the spray mechanisms, are required for these types of dispensers, all of which add to the cost and complexity of these systems.

An additional problem associated with industrial soap dispensing systems is that the user is exposed to the caustic soap at some point during the dispensing process. Thus, the systems are not closed systems where the user is insulated from potential contact with the liquid soap. For example, the user may be required to open the soap container to place a pumping mechanism in the container and may be required to internally visually inspect the soap container to determine if any soap remains in the container. All of which exposes the user to the caustic liquid soap at some point during the dispensing process.

Hand-soap liquid dispensers that are used to dispense soap for cleaning a user's hands are also known in the art, however, these types of dispensers are not applicable for use in industrial cleaning apparatuses. These devices are designed for dispensing small quantities of soap directly to a user's hands and are not designed for dispensing concentrated soap fluid to industrial cleaning apparatuses.

Therefore, it would be desirable to provide for a liquid soap dispenser that would allow for dispensing soap for use in industrial cleaning apparatuses without requiring complex pumping and/or spray mechanisms in order to dispense the soap from the container.

SUMMARY AND DISCUSSION OF THE INVENTION

The drawbacks in the prior art noted above and others are overcome by the present invention for a liquid soap dispenser for dispensing concentrated liquid soap from a soap container. As discussed in the preferred embodiment, the dispenser of the present invention includes a receiver and a seal opener. The receiver is comprised of an upper support structure and a lower soap reservoir. The upper support structure defines an interior chamber for receiving and supporting a liquid soap container. The lower soap reservoir defines an opening through which liquid soap is ultimately dispensed. The seal opener is disposed within the receiver at a lower end of the upper support structure.

The liquid soap dispenser of the present invention allows for the dispensing of liquid soap from a soap container without requiring complex pumping and/or spray mechanisms. The dispenser is simple to use and permits quick and easy delivery of concentrated liquid soap to any of a variety of different types of industrial cleaning apparatuses.

DETAILED DESCRIPTION

Figure 1:
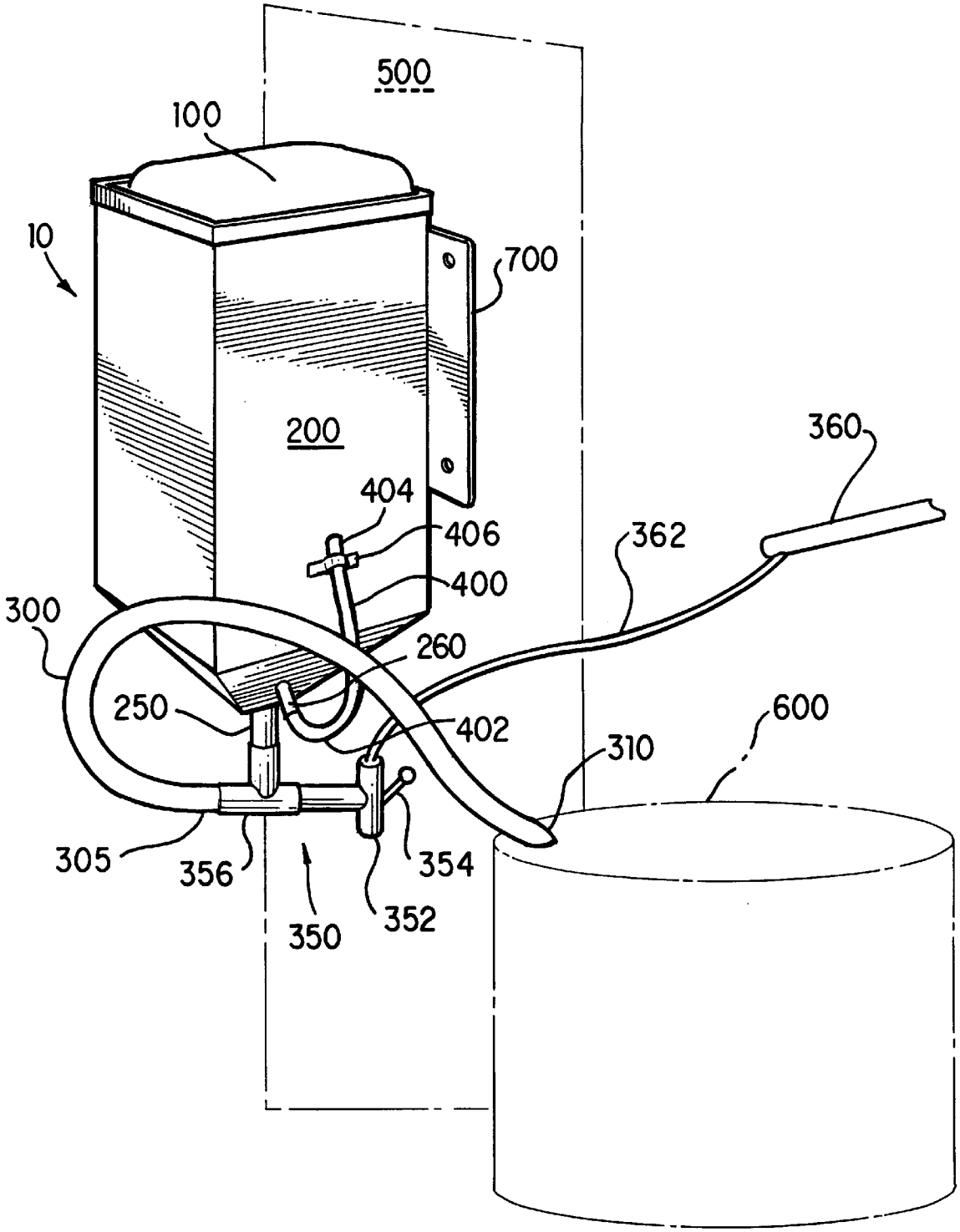
FIG. 1 is a perspective view of the liquid soap dispenser according to one embodiment of the present invention.

FIG. 1 illustrates one embodiment for the liquid soap dispenser 10 of the present invention for dispensing liquid soap into industrial cleaning apparatuses. As can be seen, a container 100, a receiver 200, and a soap conduit 300 are shown. Also illustrated are fluid transfer mechanism 350 and a soap level detector 400. In FIG. 1, the liquid soap dispenser is shown as being mounted on a wall 500 (shown in phantom) with the soap conduit 300 extending from a first end 305, where it is attached to fluid transfer mechanism 350, to a second end 310 for transferring liquid soap from the dispenser 10 to an industrial cleaning apparatus 600 (also shown in phantom).

As will be further described, soap dispenser 10 dispenses liquid soap for use in industrial cleaning apparatuses by utilizing gravity feed to transfer the liquid soap from container 100 to receiver 200. As such, no pumping mechanism is required in the present invention for drawing the liquid soap from the soap container. The soap flows from container 100 under the force of gravity into the bottom of receiver 200 from where it is dispensed to an industrial cleaning apparatus.

As illustrated in FIG. 1, dispenser 10 can be mounted to any structure, such as wall 500, by utilizing a standard mounting bracket 700 and fasteners, such as screws, bolts, etc. Bracket 700 can be either integrally formed with receiver 200 or can be attached to receiver 200 such as by welding or utilizing standard types of fastening devices. Therefore, dispenser 10 is not mounted within the cleaning apparatus into which it will be dispensing liquid soap, but rather, is located external to, and on, the cleaning apparatus or on another structure.

The present invention may be utilized to dispense liquid soap into any of a wide variety of industrial cleaning apparatuses and the present invention is not limited to dispensing liquid soap into any particular type of device. For example, dispenser 10 can be utilized to dispense liquid soap into dishwashing machines, pot sinks that are utilized for the hand washing of dishes, janitorial cleaning receptacles, laundry machines, housekeeping applications, etc. Industrial cleaning apparatus 600, as illustrated in FIG. 1, is provided to be representative of any of the types of apparatuses with which the present invention may be utilized.

Figure 2:
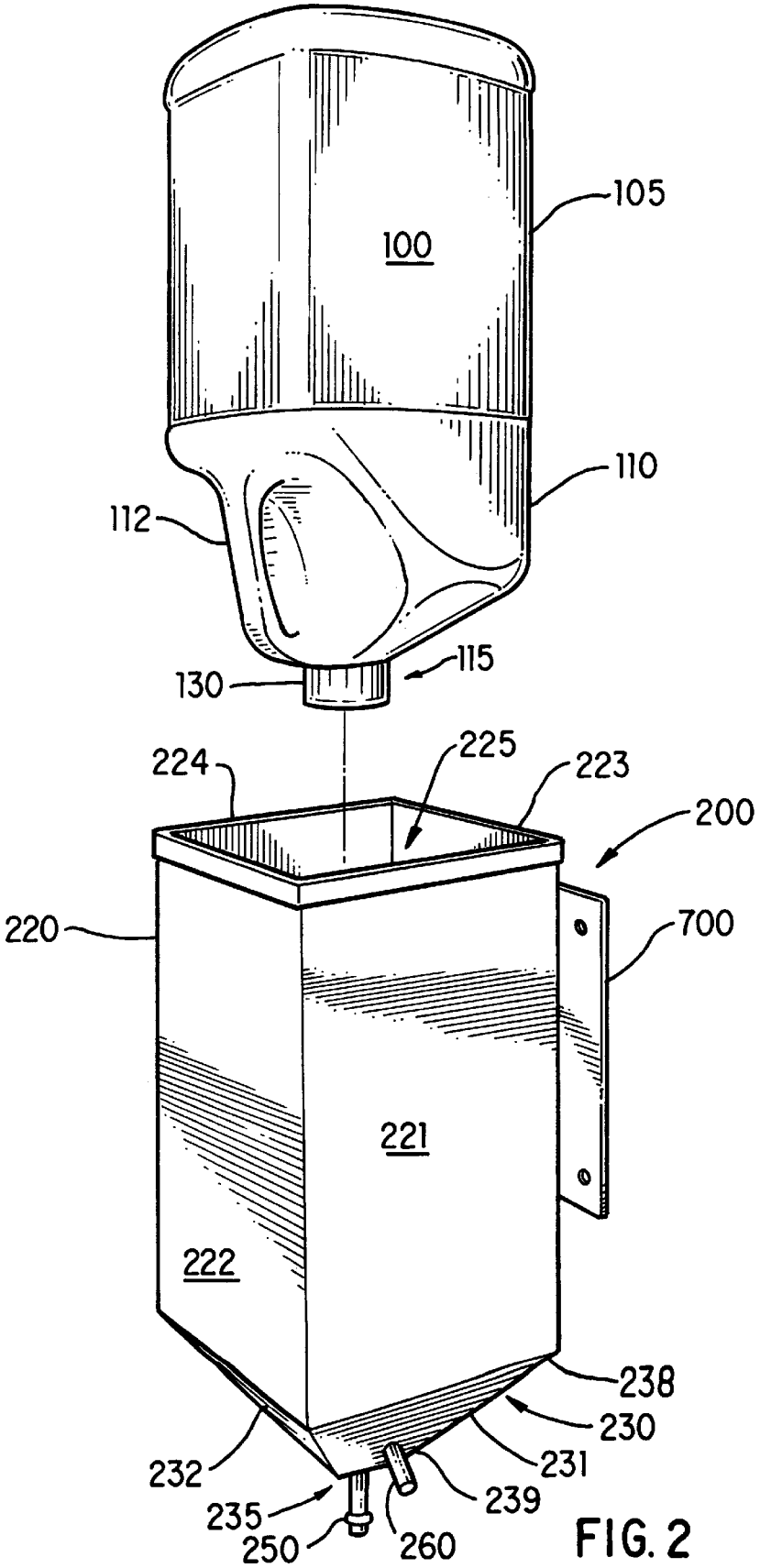
FIG. 2 is an exploded view of the receiver and container of FIG. 1.

In continuing with the discussion of the dispenser in accordance with one embodiment of the present invention, FIG. 2 illustrates the container 100 and the receiver 200 where the container 100 has not yet been inserted into the receiver 200. Container 100 is comprised of a hollow body portion 105, a shoulder portion 110, and a neck portion 115. Container 100 is designed to contain a liquid soap that is utilized in industrial cleaning apparatuses. Since the liquid soap is utilized in industrial cleaning applications, the liquid soap is in a concentrated form and is generally caustic in nature. As such, container 100 may be made of any of a variety of materials, including plastics, with the only requirement being that the material be capable of storing concentrated liquid soaps that are used in industrial applications without degrading. The container may be manufactured using a blow-molding process.

Additionally, container 100 may include a carrying handle 112 to provide for ease in transporting and handling container 100. Carrying handle 112 may be either integrally formed with hollow body portion 105 or shoulder portion 110 or may be attached to either of these portions of the container.

Container 100 may be sized to hold different quantities of liquid soap depending upon the particular application with which dispenser 10 is utilized. For example, container 100 may be sized to contain one gallon of liquid soap. One design consideration for sizing the container is that it should be sized and formed so that it is complementary in size and form with receiver 200. That is, container 100 should be formed and sized such that it snugly fits within receiver 200. In this manner, container 100 can be securely positioned within receiver 200.

Figure 3:
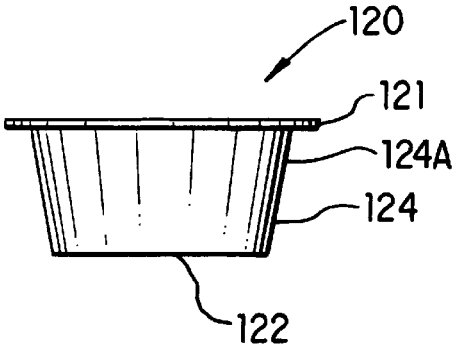
FIG. 3 is a side view of a frangible member in accordance with one embodiment of the present invention.
Figure 4:
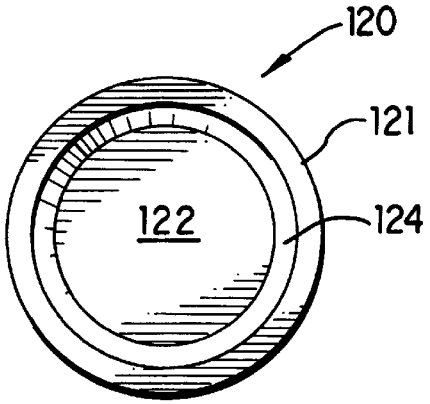
FIG. 4 is a top view of the frangible member of FIG. 3.

As mentioned previously, container 100 contains neck portion 115. Neck portion 115 is included on shoulder portion 110 and extends above shoulder portion 110 such that it defines a circular opening into container 100. Thus, liquid soap can be provided to container 100 and can be dispensed from container 100 through neck portion 115. After container 100 is filled with liquid soap, a frangible member 120, as illustrated in FIGS. 3 and 4, is placed over the opening defined by neck portion 115 to seal the liquid soap within container 100. The frangible member is placed on the container by the soap distributer, thus, by sealing the opening of the container with frangible member 120, the liquid soap container may be stored, shipped, etc., and received by the ultimate user as a sealed unit.

One embodiment for frangible member 120 is illustrated in FIGS. 3 and 4. As can be seen, frangible member 120 includes an upper rim 121 which extends around the circumference of the frangible member 120 and a bottom portion 122. The sidewall 124 of frangible member 120 extends between upper rim 121 and bottom portion 122 and narrows in diameter from the upper rim to the bottom portion. When frangible member 120 is used to seal the opening of container 100, the sidewall 124 of member 120 is inserted into the opening and an upper portion 124A of sidewall 124 snugly engages the internal wall of neck portion 115 which defines the opening of the container to securely position frangible member 120 within neck portion 115. Rim 121 is positioned on top of the wall of neck portion 115 which defines the opening. Frangible member 120 may be further glued to neck portion 115 to enhance the joining of frangible member 120 to neck portion 115 to seal the opening in the container, however, utilizing adhesives to secure the frangible member 120 to neck portion 115 to seal the container opening is not required.

Figure 8:
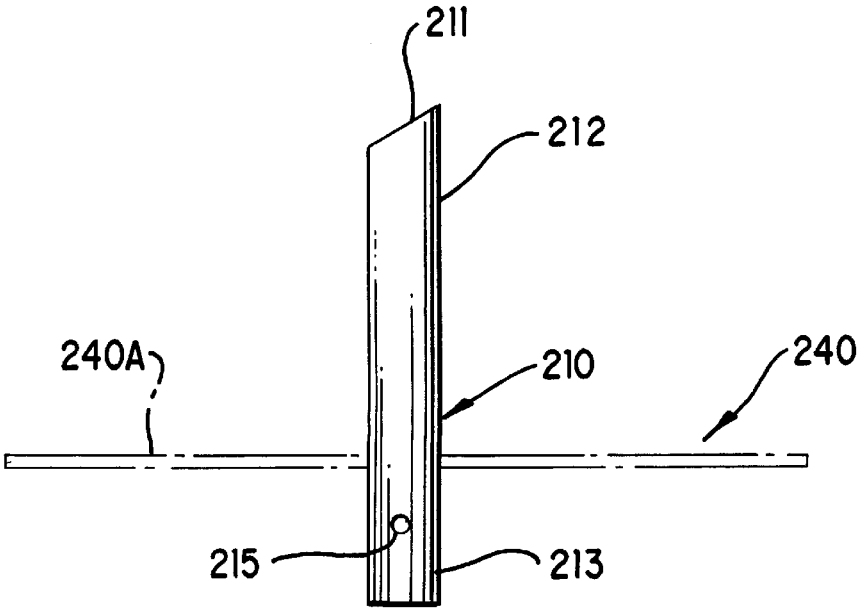
FIG. 8 is a side view of the seal opener in accordance with one embodiment of the present invention.

Frangible member 120 could be made of any of a wide variety of materials with the only requirements being that the material not degrade due to contact with the liquid soap contents of the container, be able to support any pressure that is applied to the frangible member by the liquid soap contents when the container is inverted, and be puncturable by the seal opener 210, as is shown in FIG. 8 and as will be described later, when the container is placed into the receiver. An example of a frangible member that could be utilized in the present invention is one that has been marketed under the name of "Caplug" by the Cap Plug Company with a product number designation of T-14X.

Additionally, container 100 of the present invention is not required to be sealed by utilizing a frangible member as disclosed above. Container 100 could be sealed by utilizing an adhesive to secure a material as described above over the opening defined by neck portion 115.

Figure 5:
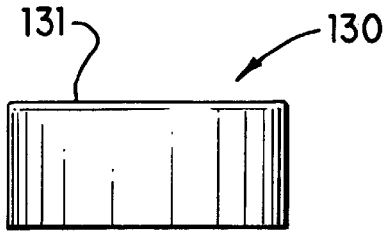
FIG. 5 is a side view of a protective cap in accordance with one embodiment of the present invention.
Figure 6:
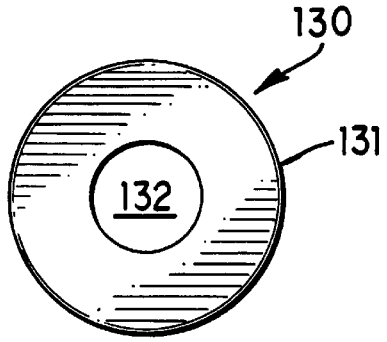
FIG. 6 is a top view of the protective cap of FIG. 5.

Neck portion 115 of container 100 is threaded on the outside surface thereof to receive protective cap 130. Cap 130 is illustrated in FIGS. 2, 5 and 6. Cap 130 is formed as a standardized cap of the type that is generally screwed onto the neck portion of a container to secure the contents of the container within the container, however, the cap as utilized with the present invention includes an opening 132 in the top 131 of the cap. The opening 132 is provided in cap 130 so that when the container 100 is inverted and placed into receiver 200, the seal opener 210 can extend up and through cap 130 so that the seal opener can puncture frangible member 120. Cap 130 is provided on container 100 so that when container 100 is empty and is removed from receiver 200, cap 130 will prevent the frangible member from being separated from container 100 by the seal opener 210 and remaining in the receiver after the container is removed.

Cap 130 can be internally threaded and, as such, is releasably threaded onto neck portion 115 of container 100 after frangible member 120 seals container 100. Alternatively, a portion of cap 130 can be integrally formed with neck portion 115 and snap-fitted on and off of neck portion 115. Regardless of how cap 130 is associated with neck portion 115, cap 130 covers frangible member 120 after frangible member 120 seals the opening in container 100.

Receiver 200 is also illustrated in FIG. 2. As can be seen, receiver 200 is hollow throughout and includes an upper support structure 220 and a lower soap reservoir 230. Upper support structure 220 is formed by four walls 221, 222, 223, and 224 which define an interior chamber 225 within upper support structure 220. Interior chamber 225 receives container 100 within it. As such, upper support structure 220 is sized and shaped to be complementary with the size and shape of container 100. As such, walls 221, 222, 223, and 224 support and stabilize the inverted container 100 when the container is placed within interior chamber 225. As illustrated, upper support structure 220 is formed in a generally square configuration, however, the configuration can be modified to accommodate and generally conform to the shape of container 100, from which the liquid soap will be dispensed. For example, if the container is cylindrical, the interior chamber could also be cylindrical in configuration.

FIG. 2 also shows lower soap reservoir 230. Lower soap reservoir 230 may be integrally formed with upper support structure 220 and narrows in diameter from an upper end 238 to a lower end 239 of the reservoir. As such, lower soap reservoir 230 has inwardly sloping walls 231, 232, 233, and 234 which serve to form the soap reservoir 230 and to direct the liquid soap that is dispensed from container 100 into soap reservoir 230 and toward an opening 235 that is located at the lowest-most point in soap reservoir 230.

Figure 7:
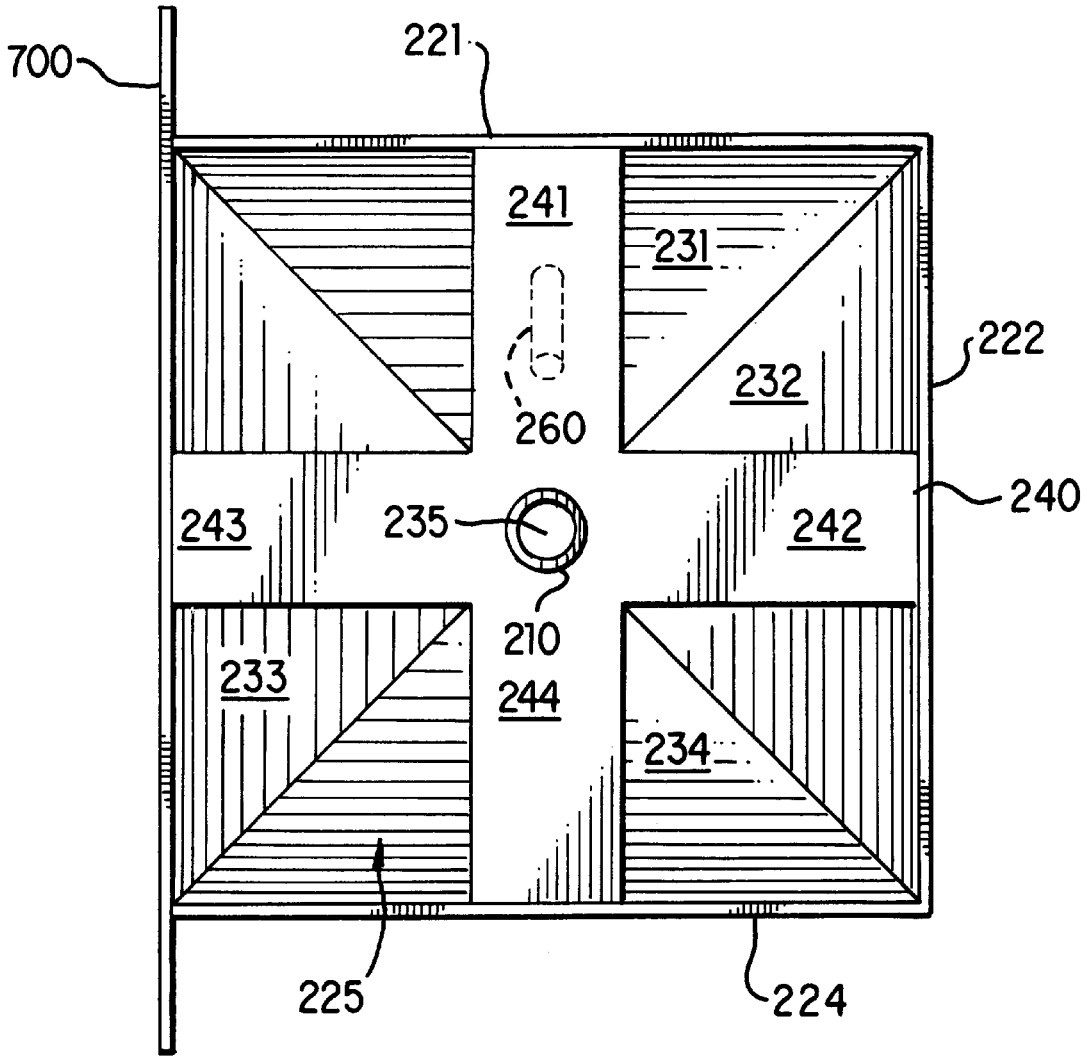
FIG. 7 is a top view of the receiver of FIG. 2

FIG. 7 provides a top view of the receiver 200 as illustrated in FIG. 2. As seen in FIG. 7, receiver 200 also contains within it seal opener 210. Seal opener 210 can also be seen in FIGS. 8 and 9. Seal opener 210 is comprised of a hollow tube structure that contains a puncture tip 211 at the upper end thereof and extends vertically within receiver 200. Seal opener 210 is vertically supported within receiver 200 by a horizontal support structure 240. Horizontal support structure 240 is comprised of four planar members 241, 242, 243, and 244 which extend from the intersection of the walls that define the upper support structure 220 and the lower soap reservoir 230 and which intersect at the seal opener 210. The upper half 212 of seal opener 210, which contains puncture tip 211, extends above the horizontal support structure 240 and the lower half 213 extends below support 240.

Although the horizontal support 240 is illustrated as being comprised of four horizontal planar members and extending around the entire circumference of the seal opener 210, the support structure is not required to be configured in this manner. For example, the support structure could only extend around a portion of the circumference of the seal opener. Additionally, although the horizontal support is preferably fixedly attached to the walls that define the interior chamber, such as by welding, the support structure could also be removably disposed within the interior chamber.

Receiver 200 and all components associated with it can be manufactured from a variety of materials. The materials, however, must not degrade due to contact with liquid industrial cleaning soaps and must be able to adequately support the soap container when the container is inserted into it. As such, hard plastics and stainless steel are two types of materials that could be utilized to manufacture the receiver.

Figure 9:
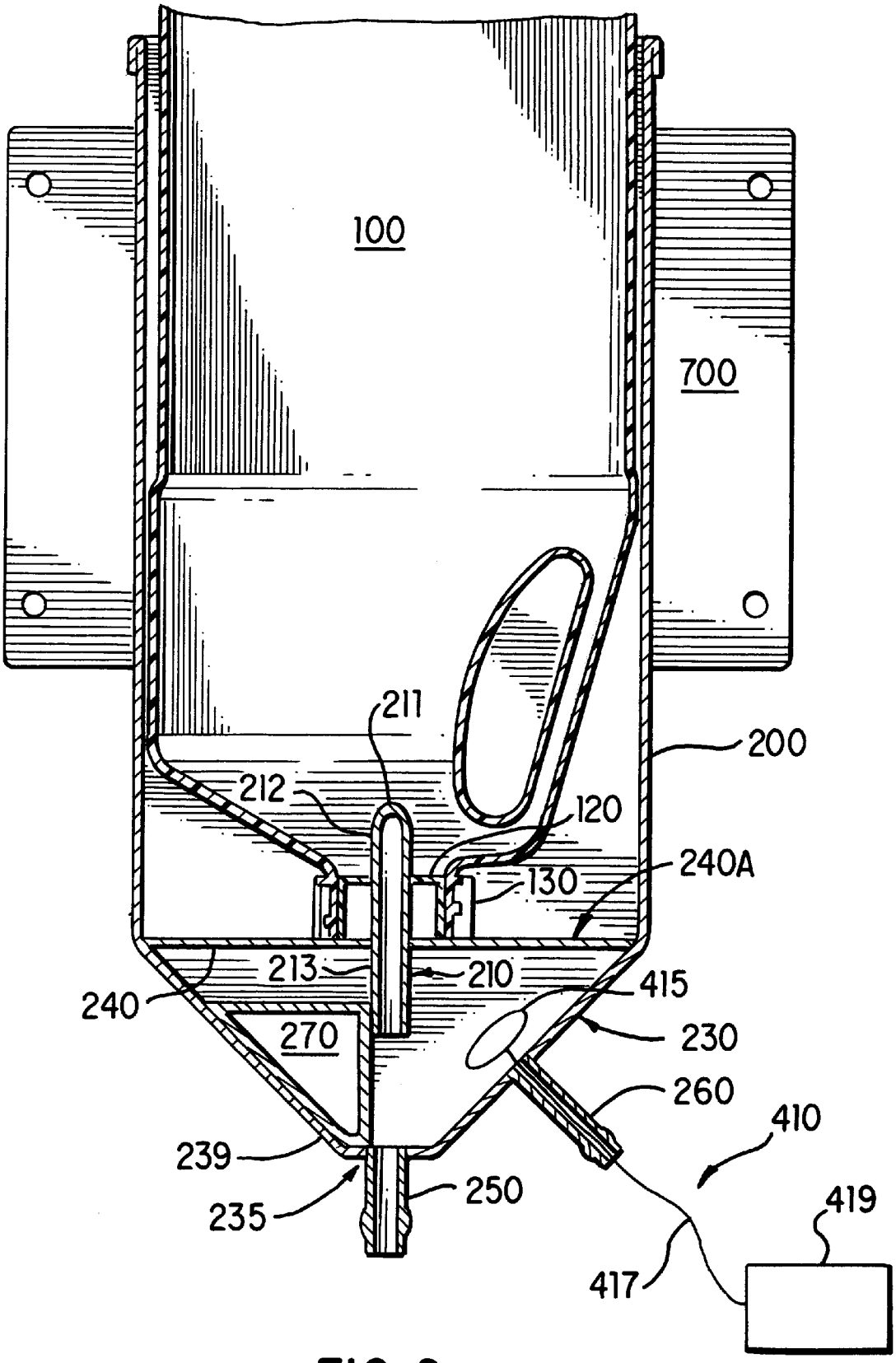
FIG. 9 is a cross-section view of the container as it is received within the receiver.

As illustrated in FIG. 9, as container 100 is positioned within receiver 200 in an inverted orientation, i.e., with neck portion 115 facing downward, seal opener 210 comes into contact with frangible member 120 and punctures frangible member 120. Interior chamber 225 is formed, and seal opener 210 is positioned, such that as container 100 is inserted into chamber 225, frangible member 120 and seal opener 210 align. Container 100 is moved downward into interior chamber 225, either by gravity or by pressure applied by a user of the dispenser, until the top of neck portion 115 rests against the upper surface 240A of the horizontal support 240. Once frangible member 120 is punctured by seal opener 210, liquid soap flows under the force of gravity from container 100 through seal opener 210 and fills lower soap reservoir 230.

Because a partial vacuum may develop in container 100 as liquid soap is dispensed from the container into lower soap reservoir 230, and thus impede the free flow of liquid from the container to the reservoir, the lower half 213 of seal opener 210 contains holes 215 in opposite sides of the tube wall structure. The purpose of the holes is to relieve the partial vacuum that is developed in container 100 as liquid soap is dispensed from the container. The size of the holes, and the number of holes provided, is dependent upon several factors and can vary depending upon the particular application with which the present invention is utilized. Several of these factors are the viscosity of the liquid soap that is contained in the container, the diameter of the tube structure of the seal opener, and the desired time period for refilling the soap reservoir. Thus, the size and number of holes provided can vary to meet particular application requirements. It is desirable that replenishment of liquid soap to the soap reservoir 230 from container 100 to replace the soap dispensed from the reservoir occur in about 10–15 seconds.

As was mentioned previously, after container 100 is fully inserted into receiver 200 and seal opener 210 punctures frangible member 120, liquid soap from container 100 will flow under the force of gravity from the container and fill lower soap reservoir 230. Soap will flow from the container into the lower soap reservoir until the level of the soap in the lower soap reservoir reaches the position from which the fluid is dispensed from the container, according to well-known principles.

There are many methods and apparatuses available for allowing the user to transfer soap to the cleaning apparatus and the present invention is not limited to any particular method or apparatus.

One embodiment for an apparatus to transfer soap to the cleaning apparatus is illustrated in FIG. 1. FIG. 1 illustrates fluid transfer mechanism 350 as including mechanically operated valve 352. In practicing the present invention by utilizing a mechanically operated valve, a tee joint 356, which is disposed over opening 235 of lower soap reservoir 230 either directly or by attachment to flow tube 250, joins the mechanical valve 352 to soap conduit 300. The mechanical valve is also connected to a water supply line 360 through tap line 362.

In operation, soap flows from container 100 and into lower soap reservoir 230 under the force of gravity and also flows through opening 235 and into tee 356 and conduit 300. Soap will not flow completely through the entire length of conduit 300 because a portion of conduit 300 is maintained at a sufficient height such that the soap liquid cannot flow against gravity. The user pulls handle 354 on the mechanical valve to open the valve which allows pressurized water to flow from the tap line 362 through the valve and into and through tee 356 and soap conduit 300. The water flow will flush the soap that is in tee 356 and conduit 300 through the conduit and transfer the soap to the cleaning apparatus. Additionally, the water flow will create a suction which will draw the soap that is contained in the lower soap reservoir from the reservoir and transfer the soap through the conduit to the cleaning apparatus. Liquid soap from container 100 will flow out of container 100 under the force of gravity and into lower soap reservoir 230 to replenish the soap that is drawn from the lower soap reservoir by the water flow. Additionally, mechanical valve 352 can include a mechanical timing device to control the period of time that the valve is open. An example of a mechanical valve that could be utilized with the present invention is one that is manufactured by the Viking Injector Company and is marketed under the name of "Viking Pot and Pan Mechanical Timer".

As mentioned previously, any of a variety of known mechanical-type valves and timing devices could be utilized with the present invention and the present invention is not limited to any particular type of valve or timing device. It is not even required that a mechanical timing device be utilized. The user could manually actuate both the opening and closing of the mechanical valve. The user would open the valve to dispense soap from the reservoir and close the valve after a desired amount of soap has been dispensed. In this manner, no mechanical timing device is required and the user would manually operate a mechanical valve to dispense a desired quantity of soap.

An alternative method for the user to mechanically control the transfer of the liquid soap from dispenser 10 to the cleaning apparatus is to utilize soap conduit 300 itself as the fluid transfer mechanism. To transfer soap from soap reservoir 230 to the cleaning apparatus, the user could permit soap to flow freely under the force of gravity from reservoir 230 to the cleaning apparatus through conduit 300. To stop the flow of soap from reservoir 230 to the cleaning apparatus, thus user would simply control the height of any portion of the soap conduit such that the soap liquid is not able to freely flow under the force of gravity through the entire length of soap conduit 300. The height of any portion of the soap conduit can be maintained at any particular height by providing any of a variety of retaining devices in the vicinity of the dispenser.

An electrically controlled solenoid valve could also be utilized with the present invention as the fluid transfer mechanism. The electrical valve could function similarly to the mechanical valve described above, however, the electrical valve would be electrically activated rather than manually activated and could include an electrical timer rather than a mechanical timer. Again, the present invention can be practiced with any of a variety of fluid transfer mechanisms. The fluid transfer mechanism is only provided to transfer the soap to the industrial cleaning apparatus and is not required to pump the soap from the soap container.

In order to assist the user in dispensing a particular desired quantity of liquid soap, soap reservoir 230 can be reconfigured such that it, and any other device that contains soap that is dispensed from container 100 before it is transferred to a cleaning apparatus, e.g., tee 356 and soap conduit 300 as discussed previously, only contains the quantity of soap that the user desires to dispense into a cleaning apparatus in a single dispensing operation. For example, if the user desires that 3 ounces of soap be dispensed to the cleaning apparatus, the reservoir 230 can be reconfigured such that it singularly, or in combination with any other device, only holds 3 ounces of soap. Thus, during any single dispensing operation, only 3 ounces of soap will be available for dispensing to the cleaning apparatus. Reconfiguration of soap reservoir 230 can be accomplished when utilizing any of the fluid transfer mechanisms discussed above, however, it has particular utility in an application where the user manually controls the transfer of liquid soap from the dispenser to the cleaning apparatus, i.e., no timing device is utilized.

Soap reservoir 230 can be reconfigured such that it is only able to contain a desired quantity of liquid soap by placing a removable volume member 270, as illustrated in FIG. 9, within soap reservoir 230. The volume member 270 could be shaped in any of a variety of configurations and any number of volume members could be placed within reservoir 230. The volume members would occupy volume within reservoir 230 such that the remaining volume in reservoir 230, i.e., that volume not occupied by volume member(s) 270, would only be able to hold a desired quantity of liquid soap. The volume members could be made of any of a variety of materials with the only requirement being that the members not absorb the liquid soap. Plastic blocks could be utilized as the volume members which would be formed to fit within the reservoir 230.

In the disclosed embodiment, soap conduit 300 is an elongated hollow tube that may be made from a variety of materials including plastic, rubber, or corrugated metal. The only design requirement is that the material be able to withstand the corrosive effects of the liquid soap that will flow through the soap conduit. Soap conduit 300 is disposed external to lower soap reservoir 230 and is in a sealable relationship with opening 235. The soap conduit can be either directly joined to receiver 200 over opening 235, such as by utilizing an adhesive, fasteners, or by welding the two members together, or can be indirectly joined with opening 235 in a sealable relationship, e.g., such as by mating with flow tube 250, or with tee 356 or a separate fluid transfer mechanism, if utilized.

Also shown in FIGS. 1, 2, and 9 is soap level detector access port 260. Soap level detector access port 260 may be formed similarly to flow control tube 250 and provides access through a wall of the lower soap reservoir. The purpose of soap level detector access port 260 is to provide for detection of the fluid level within lower soap reservoir 230. Because a user may want to know whether any fluid remains within lower soap reservoir 230, or how much fluid remains in the reservoir, without requiring the user to remove container 100 from receiver 200 to inspect the reservoir, access port 260 is provided.

Access port 260 can be utilized with a variety of soap level detection means. For example, a clear tube 400 could be attached at a first end 402 to access port 260. Liquid soap would flow, under the force of gravity, from reservoir 230 into tube 400 through access port 260. Therefore, if liquid soap was visible in clear tube 400, the user would know that soap remained in the reservoir. If the reservoir was empty, no soap would be viewable in tube 400. The second end 404 of tube 400 would be maintained at a sufficient height such that the liquid soap would remain in the tube and would not flow completely out of the tube under the force of gravity. Second end 404 can be maintained at a sufficient height by providing a retaining device 406, as illustrated in FIG. 1, on receiver 200. In this manner, a soap level detector could be provided to detect the presence of soap in the soap reservoir.

Alternatively, liquid soap level detection devices could be provided within lower soap reservoir 230 to detect the presence and/or level of soap in reservoir 230. FIG. 9 illustrates a sensor 410 that includes a sensor head 415, a sensor processor and display 419, and a transmission medium 417 for transferring data from the sensor head 415 to the processor and display 419. Sensor 410 could utilize a variety of known sensing methods, e.g., acoustic, electrical, pressure, etc., for sensing the fluid in reservoir 230 and the present invention is not limited to any particular sensing means or methods.

It is contemplated that the present invention can be practiced without requiring a soap conduit. Dispenser 10 can be physically located such that it is positioned relative to the cleaning apparatus such that liquid soap can be dispensed from the lower reservoir 230 through opening 235 directly into the cleaning apparatus solely under the force of gravity. All that would be required, if all of the liquid soap contained in the soap reservoir and the container is not to be dispensed in a single dispensing operation, is to provide a flow control mechanism that would seal the opening when the user does not desire soap to flow into the cleaning apparatus and that would not impede flow of the liquid soap into the cleaning apparatus from the reservoir under the force of gravity when the user desired to dispense soap into the cleaning apparatus. The flow control mechanism could be a simple mechanical device, such as a sliding cover, or could be an electrically operated cover.

In operation, a user of the present invention receives container 100, which is a sealed container that contains concentrated liquid soap for use in industrial cleaning apparatuses, at the site of the industrial cleaning apparatus. The user inverts container 100 and inserts it into receiver 200 in the inverted orientation. Container 100 is received within interior chamber 225 where, due to the complementary configurations of the container and the upper support structure 220, container 100 is securely positioned and supported within the receiver 200. As container 100 is lowered into receiver 200, frangible member 120, which seals the opening in the neck portion 115 of the container, contacts seal opener 210. As container 100 continues to be lowered into receiver 200, seal opener 210 punctures frangible member 120. Liquid soap from container 100 flows through seal opener 210 and fills the lower soap reservoir 230 of the receiver.

To dispense soap to an industrial cleaning apparatus, the user operates a fluid transfer mechanism. A desired amount of concentrated liquid soap, typically 1–4 ounces, is dispensed to the cleaning apparatus. As liquid soap is dispensed, the reservoir supply is automatically replenished by liquid flowing from container 100 into the reservoir under the force of gravity. Liquid soap will continue to flow from container 100 to replenish reservoir 230 until equilibrium is reached between the fluid levels in the container and the reservoir, including any other devices that contain soap before it is transferred to the cleaning apparatus.

The user can detect the presence of liquid soap remaining in reservoir 230 though use of a soap level detector. The soap level detector allows the user to determine when container 100 is empty without requiring the user to remove container 100 from the receiver 200, which could result in the user inadvertently and undesirably contacting the concentrated liquid soap. When container 100 is empty, the user removes container 100 from receiver 200 and inserts another filled, sealed container into receiver 200.

In this manner, a closed system dispenser for delivering concentrated liquid soap to an industrial cleaning apparatus is provided. Liquid soap can be efficiently dispensed to a cleaning apparatus without requiring pumping of the soap from the soap container. The liquid soap is contained in a sealed container and the sealed container is inserted into a receiver where the container is punctured and the liquid soap is dispensed into the receiver for ultimate delivery to an industrial cleaning apparatus. With the present invention, liquid soap is gravity fed from the container. The user is not exposed to the soap during the dispensing process.

The above has been a discussion of an embodiment and several alternative embodiments for the applicant's invention. It should be understood that other modifications or adaptations can be employed that are different from the embodiments that are disclosed and that still come within the scope of the present invention.

What is claimed is:

1. A dispenser for dispensing concentrated liquid soap to industrial cleaning apparatuses comprising:

a receiver, said receiver including an upper support structure and a lower soap reservoir, wherein said upper support structure defines an interior chamber within said receiver for receiving and supporting a soap container and wherein said lower soap reservoir narrows in diameter to define an opening in a lower end of said lower soap reservoir;

a seal opener, said seal opener disposed within said receiver at a lower end of said upper support structure; and a soap conduit, said soap conduit disposed exterior to said lower soap reservoir in sealable relationship with the opening defined by said lower end of said lower soap reservoir.

2. The dispenser for dispensing concentrated liquid soap to industrial cleaning apparatuses of claim 1 wherein said upper support structure and said lower soap reservoir are integrally formed.

3. The dispenser for dispensing concentrated liquid soap to industrial cleaning apparatuses of claim 1 wherein said seal opener is supported within said receiver by a horizontal support structure, said horizontal support structure having four planar members wherein each planar member extends from a mid-portion of said seal opener to a wall of said upper support structure.

4. The dispenser for dispensing concentrated liquid soap to industrial cleaning apparatuses of claim 3 wherein said seal opener is a hollow tube structure including a puncture tip at a top end thereof and wherein said hollow tube structure includes an air hole through the wall of the tube, said air hole located below said horizontal support structure.

5. The dispenser for dispensing concentrated liquid soap to industrial cleaning apparatuses of claim 1 further comprising attachment means for attaching said receiver to a generally vertical surface.

6. The dispenser for dispensing concentrated liquid soap to industrial cleaning apparatuses of claim 1 further comprising a fluid transfer mechanism, said fluid transfer mechanism disposed exterior to said lower soap reservoir and in sealable relationship with the opening defined by said lower end of said lower soap reservoir and said soap conduit.

7. The dispenser for dispensing concentrated liquid soap to industrial cleaning apparatuses of claim 6 wherein said fluid transfer mechanism is a manually operated mechanical valve.

8. The dispenser for dispensing concentrated liquid soap to industrial cleaning apparatuses of claim 1 further comprising a flow tube wherein said flow tube is disposed on the outer surface of said lower end of said lower soap reservoir and over the opening defined by the lower soap reservoir.

9. The dispenser for dispensing concentrated liquid soap to industrial cleaning apparatuses of claim 1 further comprising a soap level detector access port, said soap level detector access port being disposed through said lower soap reservoir.

10. The dispenser for dispensing concentrated liquid soap to industrial cleaning apparatuses of claim 9 further comprising a soap level detector, said soap level detector attached at a first end to said soap level detector access port.

11. The dispenser for dispensing concentrated liquid soap to industrial cleaning apparatuses of claim 10 wherein said soap level detector is a clear tube.

12. The dispenser for dispensing concentrated liquid soap to industrial cleaning apparatuses of claim 1 further comprising a volume member, said volume member disposed within said lower soap reservoir.

13. A liquid soap dispensing system for dispensing concentrated liquid soap for use in industrial cleaning apparatuses comprising:

a container wherein said container contains concentrated liquid soap and wherein said container has a neck portion defining an opening;

a frangible member, said frangible member sealably covering the opening in said container;

a receiver, said receiver including an upper support structure and a lower soap reservoir, wherein said upper support structure and said lower soap reservoir define a unitary interior chamber within said receiver for both receiving and supporting said container in an inverted orientation and for receiving concentrated liquid soap from said container and wherein an outer surface of said lower soap reservoir tapers from an upper end to a lower end to define a soap dispensing opening in said lower soap reservoir;

a seal opener, said seal opener disposed within said receiver at a lower end of said upper support structure and wherein when said container is placed within said receiver said seal opener punctures said frangible member; and a soap conduit, said soap conduit disposed exterior to said lower soap reservoir and in sealable relationship with the opening defined by said lower end of said lower soap reservoir.

14. The liquid soap dispensing system for dispensing concentrated liquid soap for use in industrial cleaning apparatuses of claim 13 wherein said soap conduit is a tube.

15. The liquid soap dispensing system for dispensing concentrated liquid soap for use in industrial cleaning apparatuses of claim 13 wherein said upper support structure is rectangular in shape and is formed to snugly receive said container within said upper support structure.

16. The liquid soap dispensing system for dispensing concentrated liquid soap for use in industrial cleaning apparatuses of claim 13 wherein said upper support structure is cylindrical in shape and is formed to snugly receive said container within said upper support structure.

17. A method for dispensing concentrated liquid soap into an industrial cleaning apparatus comprising the steps of:

inverting a container containing concentrated liquid soap, said container including a frangible seal over a mouth of said container;

inserting said inverted container into a receiver, said receiver including an upper support structure for receiving and supporting said container and a lower soap reservoir, said lower soap reservoir narrowing in diameter to define an opening in said lower soap reservoir;

puncturing said frangible seal over said mouth of said container by a seal opener, said seal opener disposed within said receiver at a lower end of said upper support structure;

dispensing a quantity of said concentrated liquid soap from said container into said lower soap reservoir, wherein said quantity of said concentrated liquid soap is dispensed from said container by the force of gravity acting upon said concentrated liquid soap; and transferring a quantity of said concentrated liquid soap from said lower soap reservoir to an industrial cleaning apparatus.

18. The method of claim 17 further comprising the step of controlling the quantity of said concentrated liquid soap transferred from said lower soap reservoir to the industrial cleaning apparatus.

19. The method of claim 18 wherein said step of controlling the quantity of said concentrated liquid soap transferred from said lower soap reservoir to the industrial cleaning apparatus comprises the step of activating an electrically controlled solenoid valve.

20. The method of claim 18 wherein said step of controlling the quantity of said concentrated liquid soap transferred from said lower soap reservoir to the industrial cleaning apparatus comprises the step of manually adjusting the height of a portion of a soap conduit.

21. The method of claim 17 further comprising the step of sensing the presence of concentrated liquid soap in said lower soap reservoir.

22. The method of claim 17 further comprising the step of reconfiguring said lower soap reservoir such that said lower soap reservoir contains a desired quantity of soap that is to be dispensed to the industrial cleaning apparatus in a single dispensing operation.

23. The method of claim 17 wherein said step of transferring a quantity of said concentrated liquid soap from said lower soap reservoir to an industrial cleaning apparatus comprises the step of transferring the liquid soap from said lower soap reservoir to the industrial cleaning apparatus under the force of gravity.

24. A method for dispensing concentrated liquid soap from a closed dispensing system to an industrial cleaning apparatus comprising the steps of:

filling a container with concentrated liquid soap at a location separate from a location where the concentrated liquid soap is to be dispensed;

sealing said container at the filling site by utilizing a frangible member;

transporting said sealed container to the location where the concentrated liquid soap will be dispensed;

inverting said sealed container by a user;

inserting said inverted container into a receiver, said receiver including an upper support structure for receiving and supporting said container and a lower soap reservoir, said lower soap reservoir narrowing in diameter to define an opening in a lower end of said lower soap reservoir;

puncturing the sealed container by a seal opener, said seal opener disposed within said receiver at a lower end of said upper support structure;

dispensing a quantity of said concentrated liquid soap from said container into said lower soap reservoir, wherein said quantity of said concentrated liquid soap is dispensed from said container by the force of gravity acting upon said concentrated liquid soap and wherein said concentrated liquid soap flows from said container into said lower soap reservoir until a level of concentrated liquid soap in said lower soap reservoir at least reaches a position at which said sealed container is punctured;

transferring a quantity of said concentrated liquid soap from said lower soap reservoir to an industrial cleaning apparatus;

determining whether a quantity of concentrated liquid soap remains in said lower soap reservoir;

removing said container from said receiver when said container is empty of said concentrated liquid soap; and inserting a second filled sealed container containing concentrated liquid soap into said receiver.

25. The method of claim 24 further comprising the step of attaching a protective cap on said container, a portion of said protective cap being disposed over said frangible member after said container is sealed and wherein said portion of said protective cap disposed over said frangible member defines an opening in said protective cap.

26. The method of claim 24 wherein said step of transferring a quantity of said concentrated liquid soap from said lower soap reservoir to an industrial cleaning apparatus comprises the step of transferring the liquid soap from said lower soap reservoir to the industrial cleaning apparatus under the force of gravity.

27. A dispenser for dispensing concentrated liquid soap to industrial cleaning apparatuses comprising:

a receiver, said receiver including an upper support structure and a lower soap reservoir, wherein said upper support structure defines an interior chamber within said receiver for receiving and non-sealingly supporting a soap container and wherein said lower soap reservoir narrows in diameter to define an opening in a lower end of said lower soap reservoir; and a seal opener, said seal opener disposed within said receiver at a lower end of said upper support structure.

28. The dispenser for dispensing concentrated liquid soap to industrial cleaning apparatuses of claim 27 further comprising a flow control mechanism, said flow control mechanism disposed external to said lower soap reservoir and over the opening defined by said lower soap reservoir, said flow control mechanism movable between a first position where said flow control mechanism seals the opening and a second position where said flow control mechanism permits flow of liquid soap from said lower soap reservoir through the opening.

29. The method of claim 17 wherein said quantity of said concentrated liquid soap is transferred from said lower soap reservoir to the industrial cleaning apparatus by pressurized water.

30. A method for dispensing a concentrated liquid cleaning fluid in a closed dispensing system to an industrial cleaning apparatus comprising the steps of:

filling a container with the concentrated liquid cleaning fluid at a location separate from a location where the concentrated liquid cleaning fluid is to be dispensed;

sealing said container at the filling site by utilizing a frangible member;

transporting said sealed container to the location where the concentrated liquid cleaning fluid will be dispensed;

inserting said sealed container into a receiver, said receiver including a reservoir and an upper support structure;

non-sealingly supporting said sealed container within said receiver;

puncturing the sealed container by a container opener, said container opener disposed within said receiver;

dispensing a quantity of said concentrated liquid cleaning fluid from said container into said reservoir, wherein said quantity of said concentrated liquid cleaning fluid is dispensed from said container by the force of gravity acting upon said concentrated liquid cleaning fluid; and transferring a quantity of said concentrated liquid cleaning fluid from said reservoir to an industrial cleaning apparatus.

31. The method of claim 30 further comprising the steps of:

removing said container from said receiver when said container is empty of said concentrated liquid cleaning fluid; and inserting a second filled sealed container containing concentrated liquid cleaning fluid into said receiver.

32. The method of claim 30 further comprising the step of aligning said sealed container with said container opener by abutting said sealed container with said upper support structure.

33. The method of claim 30 further comprising the step of inverting said sealed container by a user before inserting said sealed container into said receiver.

34. The method of claim 30 wherein said concentrated liquid cleaning fluid is a soap.

35. The method of claim 30 wherein said concentrated liquid cleaning fluid is a detergent.

36. The method of claim 30 wherein said step of transferring a quantity of said concentrated liquid cleaning fluid from said reservoir to an industrial cleaning apparatus comprises the step of transferring said concentrated liquid cleaning fluid from said reservoir to the industrial cleaning apparatus under the force of gravity.

37. The method of claim 30 wherein said step of transferring a quantity of said concentrated liquid cleaning fluid from said reservoir to an industrial cleaning apparatus comprises the step of drawing a suction on said reservoir, said suction drawn by a pressurized water supply.

38. A method for dispensing concentrated liquid cleaning fluid from a container, comprising the steps of:

inserting said container into a receiver, said receiver defining a unitary chamber therein which includes an upper support structure and a reservoir, said unitary chamber receiving at least a portion of said container within said unitary chamber;

puncturing said container by an opener, said opener disposed within said receiver;

dispensing a quantity of the concentrated liquid cleaning fluid from said container into said reservoir, wherein said quantity of the concentrated liquid cleaning fluid is dispensed from said container by the force of gravity acting upon the concentrated liquid cleaning fluid; and transferring a quantity of the concentrated liquid cleaning fluid from said reservoir through a liquid cleaning fluid conduit.

39. The method of claim 38 further comprising the step of inverting said container containing concentrated liquid cleaning fluid before the step of inserting said container into said receiver.

40. The method of claim 38 wherein said concentrated liquid cleaning fluid is a soap.

41. The method of claim 38 wherein said concentrated liquid cleaning fluid is a detergent.

42. The method of claim 38 further comprising the step of controlling the quantity of the concentrated liquid cleaning fluid transferred from said reservoir.

43. The method of claim 42 wherein said step of controlling the quantity of said concentrated liquid cleaning fluid transferred from said reservoir comprises the step of controlling the flow of a pressurized water supply.

44. The method of claim 38 wherein said step of transferring a quantity of the concentrated liquid cleaning fluid from said reservoir comprises the step of drawing a suction on said reservoir, said suction drawn by a pressurized water supply.

45. The method of claim 44 wherein said step of drawing a suction on said reservoir by said pressurized water supply includes the step of diluting the concentrated liquid cleaning fluid with the pressurized water supply.

46. The method of claim 38 further comprising the step of detecting a level of the concentrated liquid cleaning fluid within said reservoir.

47. A dispenser for dispensing concentrated liquid cleaning fluid from a sealed container to a cleaning apparatus, comprising:

a receiver defining an interior chamber, said interior chamber receiving at least a portion of the sealed container within said chamber;

a container opener disposed within said receiver;

a reservoir in fluid communication with said interior chamber such that concentrated liquid cleaning fluid can flow from the container into said reservoir; and a cleaning fluid conduit in fluid communication with said reservoir.

48. The dispenser of claim 47 further comprising a fluid transfer mechanism attached to said cleaning fluid conduit, said fluid transfer mechanism drawing a suction on said reservoir through said cleaning fluid conduit to dispense the concentrated liquid cleaning fluid from said reservoir.

49. The dispenser of claim 48 wherein said fluid transfer mechanism utilizes a pressurized water supply to draw the suction on said reservoir.

50. The dispenser of claim 49 wherein said fluid transfer mechanism dilutes the concentrated liquid cleaning fluid with the pressurized water supply.

51. The dispenser of claim 47 wherein said container opener defines a puncture tip at a top end thereof.

52. The dispenser of claim 47 wherein said cleaning fluid conduit is a tube.

53. The dispenser of claim 47 wherein the concentrated liquid cleaning fluid flows through said cleaning fluid conduit under the force of gravity.

54. The dispenser of claim 47 wherein said concentrated liquid cleaning fluid is a soap.

55. The dispenser of claim 47 wherein said concentrated liquid cleaning fluid is a detergent.

56. A concentrated liquid cleaning fluid dispensing apparatus for industrial washing machines, comprising:

a sealed container containing concentrated liquid cleaning fluid;

a receiver defining an interior chamber, said interior chamber receiving at least a portion of said sealed container within said chamber;

a container opener disposed within said receiver; and a reservoir in fluid communication with said interior chamber wherein a quantity of concentrated liquid cleaning fluid can flow from said container into said reservoir and wherein said concentrated liquid cleaning fluid flows from said container into said reservoir until a level of concentrated liquid cleaning fluid in said reservoir at least reaches a position at which said container is sealed.

57. The concentrated liquid cleaning fluid dispensing apparatus of claim 56 wherein the quantity of concentrated liquid cleaning fluid flows from said container into said reservoir under the force of gravity.

58. The concentrated liquid cleaning fluid dispensing apparatus of claim 56 wherein said concentrated liquid cleaning fluid is a soap.

59. The concentrated liquid cleaning fluid dispensing apparatus of claim 56 wherein said concentrated liquid cleaning fluid is a detergent.

60. The concentrated liquid cleaning fluid dispensing apparatus of claim 56 further comprising a cleaning fluid conduit, said cleaning fluid conduit in fluid communication with said reservoir.

61. The concentrated liquid cleaning fluid dispensing apparatus of claim 60 further comprising a fluid transfer mechanism attached to said cleaning fluid conduit, said fluid transfer mechanism drawing a suction on said reservoir through said cleaning fluid conduit to dispense the concentrated liquid cleaning fluid from said reservoir.

62. The concentrated liquid cleaning fluid dispensing apparatus of claim 61 wherein said fluid transfer mechanism utilizes a pressurized water supply to draw the suction on said reservoir.

63. The concentrated liquid cleaning fluid dispensing apparatus of claim 62 wherein said fluid transfer mechanism dilutes the concentrated liquid cleaning fluid with the pressurized water supply.

64. The concentrated liquid cleaning fluid dispensing apparatus of claim 56 wherein said container includes a frangible seal over a mouth of said container and wherein said container and said receiver are formed with complementary structures such that said frangible seal is aligned with said container opener when said container is positioned within said chamber.

65. An industrial cleaning system, comprising:

a sealed container containing concentrated liquid cleaning fluid, said sealed container having a neck portion defining an opening therein and a frangible member sealingly disposed over said opening;

a receiver including a lower reservoir and an upper support structure, said upper support structure defining an interior chamber for receiving and supporting at least a portion of said container in an inverted orientation, said upper support structure and said lower reservoir in fluid communication;

a container opener disposed within said receiver at a lower end of said upper support structure;

wherein said container and said upper support structure have complementary structures such that when said container is placed within said upper support structure said container and said upper support structure are not in a sealable relationship with each other and said container opener is aligned with said frangible member such that said container opener punctures said frangible member such that concentrated liquid cleaning fluid can flow from said container to said lower reservoir under the force of gravity;

a cleaning fluid conduit in fluid communication with said reservoir;

a fluid transfer mechanism attached to said cleaning fluid conduit at a first end, said fluid transfer mechanism utilizing a pressurized water supply to draw a suction on said reservoir through said cleaning fluid conduit and dispense the concentrated liquid cleaning fluid from said reservoir, said pressurized water diluting said concentrated liquid cleaning fluid; and an industrial cleaning apparatus receiving a second end of said fluid transfer mechanism, said fluid transfer mechanism providing said diluted liquid cleaning fluid to said industrial cleaning apparatus.

* * * * *